United States Patent [19]

McGivern, Jr.

[11] 4,261,804

[45] Apr. 14, 1981

[54] SELECTIVE REMOVAL OF NICKEL-BASED ALLOYS FROM FERROUS-BASED METALS

[75] Inventor: James F. McGivern, Jr., Avon, Conn.

[73] Assignee: United Technologies Corporation, Hartford, Conn.

[21] Appl. No.: 93,655

[22] Filed: Nov. 13, 1979

[51] Int. Cl.[3] ..... C25F 5/00; C25F 3/00

[52] U.S. Cl. ..... 204/146; 204/140

[58] Field of Search ..... 204/140, 146

[56] References Cited

U.S. PATENT DOCUMENTS

| | | | |
|---|---|---|---|
| 2,549,411 | 4/1951 | Bell | 204/146 |
| 2,581,490 | 1/1952 | Larsen | 204/146 |
| 2,596,307 | 5/1952 | Stuffer | 204/146 |
| 2,797,194 | 6/1957 | Anderson | 204/146 |
| 2,937,940 | 5/1960 | Weisberg | 75/97 |
| 3,649,489 | 3/1972 | Dillenberg | 204/146 |
| 3,694,333 | 9/1972 | Ducrot | 204/140 |
| 3,751,352 | 8/1973 | Blair | 204/145 R |
| 3,788,958 | 1/1974 | Dillenberg | 204/146 |
| 3,819,494 | 6/1974 | Fountain | 204/146 |
| 3,826,724 | 7/1974 | Riggs, Jr. | 204/146 |
| 3,886,055 | 5/1975 | Baboian | 204/146 |
| 3,892,612 | 7/1975 | Carlson | 156/150 |
| 3,900,375 | 8/1975 | Baboian | 204/146 |
| 3,943,043 | 3/1976 | Billington | 204/146 |
| 4,161,434 | 7/1979 | Quinlan | 204/146 |

OTHER PUBLICATIONS

Metal Industry, Feb. 16, 1945, p. 102.

*Primary Examiner*—T. M. Tufariello
*Attorney, Agent, or Firm*—Harry J. Gwinnell

[57] ABSTRACT

Nickel-based alloys can be removed from ferrous-based metals without damaging the ferrous-based metal by a process comprising immersing the nickel-based alloy/ferrous-based metal composite into an electrolyte solution which will not attack the ferrous-based metal at a specified voltage condition. This voltage condition is imposed across the composite and potentiostatically controlled to produce a nickel-alloy/ferrous-metal current density ratio in the composite which results in etching of the nickel-based alloy with no damage to the ferrous-based metal. The process has particular utility for removing nickel-based alloy brazed vanes from stainless steel shrouds in gas turbine engine stators.

7 Claims, 6 Drawing Figures

SELECTIVE REMOVAL OF NICKEL-BASED ALLOYS FROM FERROUS-BASED METALS

Description

1. Technical Field

The field of art to which this invention pertains is etching, and specifically electrochemical etching.

2. Background Art

A typical problem in removing braze alloy from brazed metal structures is the preservation of the base metal structure undamaged. This problem is complicated by the fact that more often than not the braze alloy and base metal have many elements in common. Accordingly, in trying to destroy the braze alloy there is great tendency for destroying the base metal as well. With precious metal braze alloys the problem is readily solvable based on the knowledge that precious metal alloys have well known solubility in certain chemicals which do not attack conventional base metals such as stainless steel. This makes the selective chemical etching of precious metal-based alloy from the base metal easily attainable. However, because of the increasingly limited availability of precious metals for this purpose it has been necessary to look to other alloy materials for brazing. Nickel-based alloys have been found to be quite an acceptable substitute. But it is well known that conventional chemical etch solutions will not etch nickel-based alloys without base metal damage, if at all. In fact, the only practical method of effecting nickel braze alloy removal from the ferrous-based metal has been electrostatic discharge machining which is extremely time-consuming and labor intensive.

Accordingly, what is needed in the art is an efficient method for selectively removing nickel-based alloy from ferrous-based metals which leaves the ferrous-based metal in undamaged form.

Disclosure of Invention

The present invention is directed to a process for the selective removal of nickel-based alloys from ferrous-based metals while leaving the ferrous-based metal in undamaged form which comprises first immersing the nickel alloy-ferrous based metal composite into an electrolyte solution which will not attack the ferrous-based metal at a specified voltage condition. Such voltage condition is next imposed across the composite and potentiostatically controlled so as to produce a nickel-alloy ferrous-metal current density ratio in the composite which etches the nickel-based alloy without damaging the ferrous-based metal.

In another aspect of the invention, a process for electrochemically removing nickel alloy braze from a vane-shroud stator of a gas turbine engine without damaging the shroud is disclosed. As above, the vane-shroud composite is immersed in an electrolyte solution which will not attack the shroud at a specified voltage condition. Such voltage condition is imposed across the composite and potentiostatically controlled so as to produce a braze-shroud current density ratio in the composite which etches the braze alloy without damaging the shroud and permits mechanical removal of the vanes from the shroud also without damaging the shroud.

Figure 1:
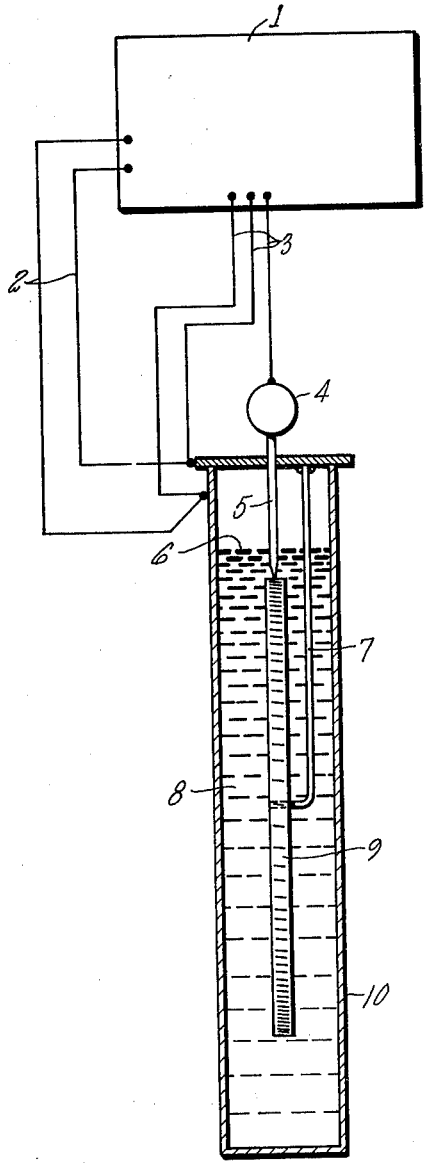
FIG. 1 shows schematically a potentiostatic setup for performing the process of the present invention.

Best Mode for Carrying Out the Invention

Chemical reactions such as those involved in stripping of braze alloy and corrosion inhibition of base metals are regulated thermodynamically by the change in free energy of the reactants. These are readily discernible electrochemically by the relationship between the free energy and potentials of the reacting species in electrolytic solutions. The collection of such information is readily revealed by volt-ammetry studies employing potentiokinetic techniques. In the present invention the potential regions in which current densities were large and small in the braze alloy and base metal respectively were determined potentiokinetically in selected electrolytes. These conditions of voltage and electrolyte which resulted in low base metal current density and high alloy current density were then selected for performance of the present invention.

In this system a programmable potentiostat is utilized to govern the difference in voltage between the working electrode (braze alloy-base metal composite) and a reference electrode by constraining the working electrode current density to change in response to a programmed demand for a change in the voltage difference. This allows a sweep of each individual piece to be monitored, thus assuring the proper voltage producing the proper current density in the alloy for each composite. For example, referring to FIG. 3, there are many points on the graph where the workpiece has the same current density at different voltages. If this voltage were not monitored it is possible that the ferrous metal could be attached as well as the nickel alloy if the process were allowed to proceed based on current density alone. But by monitoring current density at a particular voltage this possibility is eliminated.

Initial work was performed on a 3 ampere programmable Wenking Potentiostat (Elektronischer Potentiostat nach Wenking) and later work was performed on a 100 ampere programmable potentiostat custom made by Hamilton Standard. While a constant voltage potentiostat could be used once the sweep or curve of a particular composite is determined, in view of the importance of avoiding any detectable attack of the shroud material it is much preferred to use a programmable potentiostat to view the entire sweep of the composite before settling on and holding a particular voltage. The programmable potentiostat provides the ability to hold the potential of the composite constant without any reference to what the cathode is doing. The potentiostat measures the composite potential with reference to a stable electrode such as a $Hg/Hg_2SO_4$ electrode. With the potentiostat there is a nonchanging voltage with a high input impedance in the order of 300 megohms, and virtually no current passing in the reference electrode loop which might change the potential of that electrode. In the case at hand the stainless steel tank is the cathode but the cathode can be any cathode material such as a lead plate or filament of any material compatible with the electrolyte. Again, as stated, a fixed point potentiostat is workable but a potentiostat which is programmable is much more desirable in the present process because (1) the nickel-based alloy can be removed with a potentiostat unit with much smaller current capability since current spikes can be monitored and minimized and (2) the whole sweep of the workpiece can be monitored and the particular potential of the workpiece can both be accurately fixed on and optimized. Furthermore, for quality control purposes the sweep of each piece may be recorded and inspected which is essential for a commercially viable process since replacement of a shroud, for example, would be an excessively expensive operation. By matching the charts for each piece (e.g., FIG. 5) any discrepancies in recorded treatment would be readily discernable.

An essential component in the system of the present invention is the electrolyte. The electrolyte is chosen based on its effect on relative current densities which result in the nickel alloy and ferrous metal when voltages are imposed across the workpiece in its presence. A variety of acids such as phosphoric acid or bases such as sodium hydroxide can be used, but sulfuric acid is preferred because its good conductivity provides relatively even distribution of current density over the surfaces of irregularly shaped parts, and relative ease of passivation of stainless steel. Also, the decomposed brazed alloy components, such as the nickel, form soluble sulfates when reacted with sulfuric acid under the conditions of the present invention enabling their removal from the reaction cite permitting, therefore, unimpeded progress of the process. For example, an electrolyte which resulted in the precipitation of the braze alloy decomposition components in addition to restricting the life of the bath would tend to form undesirable deposits on the workpiece as well. For similar reasons complex-forming electrolytes such as ammonia-, cyanide- and phosphate-, etc., containing electrolytes are also contemplated. From the figures it appears that, of the electrolytes tested, NaOH gives the most quantitative current density separation. However, the time factor for braze removal makes the sulfuric acid the better choice. The sulfuric system appears to remove the braze at a faster rate without any detectable stainless attack per time of braze removal. For example, based on the data in FIGS. 2 and 4, in the 0.8 to 1.0 voltage bracket the sulfuric acid produced a current density approximately 30 times that of the NaOH system tested. If NaOH is used, however, it should be used in 0.1 to 0.5 N solution with 0.1 to 0.3 N preferred.

Two determinative factors for selecting concentration of electrolyte in the braze removal solution are (1) sufficient electrolyte to provide the requisite conductivity to impose the desired voltage uniformly across the workpiece but (2) without attacking the ferrous metal substrate at such voltage. In the case of sulfuric acid, solutions from 1 to 20% by volume can be used with 4 to 6% being preferred. The preferred solution produces a pH of about 1 but pH strength itself is not a critical factor. For each pH unit change there is a voltage shift of approximately 0.06 volt. However, as can be seen from the figures, the key parameter in the process of the present invention is not the percents of components or specific voltage or current densities but rather the most favorable ratio of braze attack versus stainless steel attack. This is measurable as relative current densities or ratio of current densities for a particular voltage.

A stator to be overhauled was processed according to the present invention as follows. The stator was cleaned. The vanes were next torch-cut to a height over the inner shroud of about $\frac{3}{4}$ of an inch (about 2 cm). This eliminated the outer shroud which is not brazed and minimizes process current requirements. The inner shroud and vane stubs are next grit blasted to desmut and further clean the workpiece. Silicon carbide can be used as the grit blasting medium. The stator thus treated is then suspended statically in a 5% (by volume) water solution of sulfuric acid as shown schematically in FIG. 1. A programmable potentiostat is next utilized to impose a voltage of approximately 0.95 volt in the cathodic sense on the workpiece versus the mercury/mercuric sulfate reference electrode. This is done for 30 to 60 seconds to hydrogen flush the workpiece surface providing a further cleaning. Voltage is brought back to 0 and polarity reversed to begin the selective nickel-alloy braze removal. The workpiece is potentiokinetically swept anodically on a linear ramp at 50 millivolts per minute to 0.95 volt ($\pm$0.01 volt) versus the reference cell and held at this potential potentiostatically for the duration of the stripping cycle. For the vanes and stator used in this example, this was approximately 16 hours. Following this, the power is turned off and the stator is rinsed and dried. Silicon carbide grit blast is used to dislodge braze alloy degraded components. At this point braze fillets and braze overrun are completely removed and stripping can be detected in the crevices between the vanes and shrouds. While in some cases this single treatment may be sufficient to permit simple mechanical removal of the vanes, it is more likely that the steps will have to be repeated at least one more time. In this particular example, extensive stripping in the crevices between the vanes and shroud developed after a second run. The braze alloy remaining was quite porous, badly weakened and in some locations light could be seen between the vanes and the shrouds at the joints. At this point, the vanes were removed with hydraulic press and dies after grinding of the stakes and tack welds used for temporary structure alignment during manufacture prior to and during brazing. The process can be repeated further to remove residual braze alloy sufficient to facilitate insertion of new vanes into the treated shroud.

As evidenced by this example, the method described represents a significant advance in this art with substantial savings of labor effort. While the total stripping time may be typically 32 hours, the setup and process operation may require operator attention of only 30 minutes. This is in major contrast to conventionally used processes for removing nickel-containing braze alloys from stainless steel composites such as electrostatic discharge machining which may require 24 or more labor intensive hours to accomplish the same result.

A closer inspection of the accompanying figures will help to better understand the invention and underscore its advantages. FIG. 1 shows schematically apparatus useful in the performance of the present invention. In the figure, the potentiostat is indicated as 1, with power leads 2 and sensing leads 3. The reference electrode is indicated as 4 and Luggin capillary and acid bridge 5. The electrolyte level 6 of the electrolyte solution 8 is maintained sufficiently high in tank 10 so as to completely cover the stator 9 suspended in the electrolyte by hanger 7.

Figure 2:
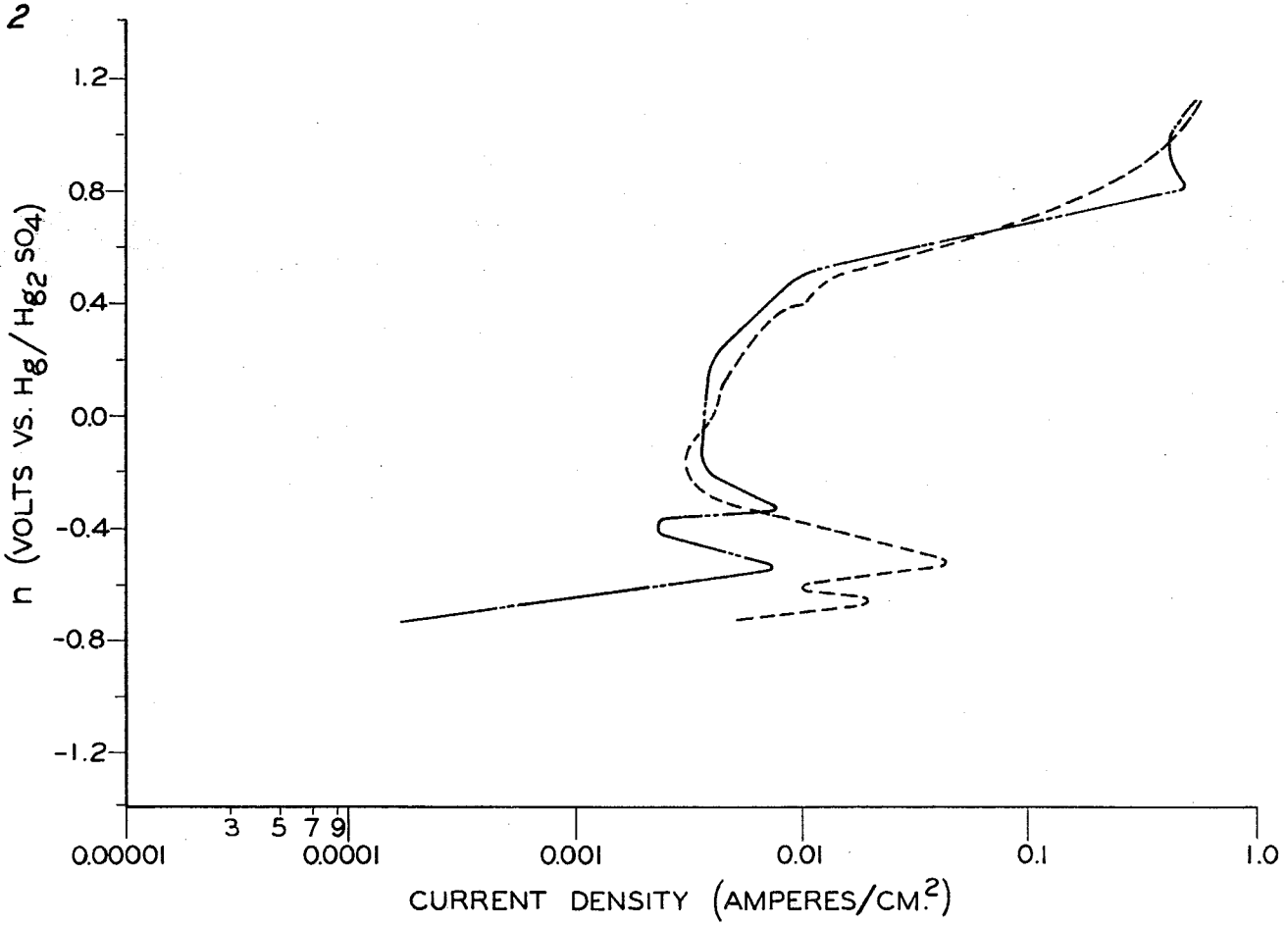
FIG. 2 is a graphic representation of current density in nickel alloys of the present disclosure as a function of voltage.
Figure 3:
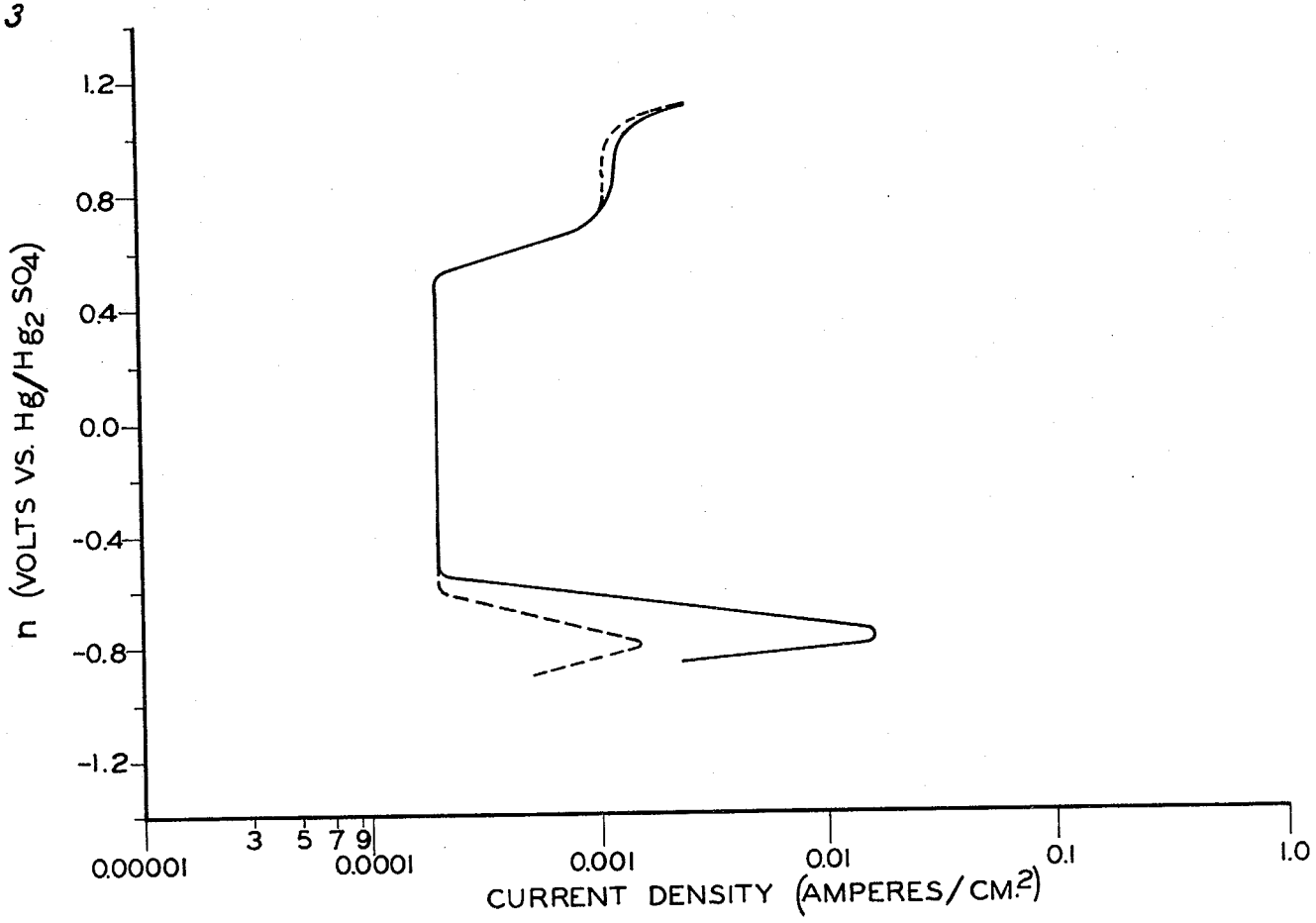
FIG. 3 demonstrates current density of a stainless steel surface of the present invention as a function of voltage.

FIGS. 2 and 3 should be viewed together. FIG. 2 demonstrates the current density of a typical nickel-based braze alloy as a function of voltage imposed across the alloy. In FIGS. 2 and 3 the solid line indicates potential integrated cathodic to anodic and the broken line potential integrated anodic to cathodic which serves as a check and eliminates artifact. FIG. 3 demonstrates the current density of a typical ferrous-based stainless steel. In the samples tested the alloy had a composition comprising about 4.5% silicon, 13% chromium, 4% iron, 3% boron and the balance nickel. The composition of the stainless steel comprised about 12.5% chromium with the balance iron. It should be noted, however, that the present invention is not limited to this particular nickel-based braze alloy or ferrous-based metal but will similarly perform on other nickel alloy-ferrous metal composites as well. It should also be noted that while the scope of investigation of the present invention centered on the removal of nickel-based braze alloy from ferrous-based metal there is no reason to expect that the present process would not work equally as well on other braze-base metal systems with discernable corrosion rate differences such as, e.g., brass braze-copper based metal, aluminum braze-aluminum alloy, etc.

By viewing FIGS. 2 and 3 together it is apparent that by selecting a voltage between approximately 0.8 and 1.0 the ratio of current density in the alloy is approximately 395 times that present in the ferrous metal, which would clearly preferentially etch the alloy composition in a reasonable amount of time.

Figure 4:
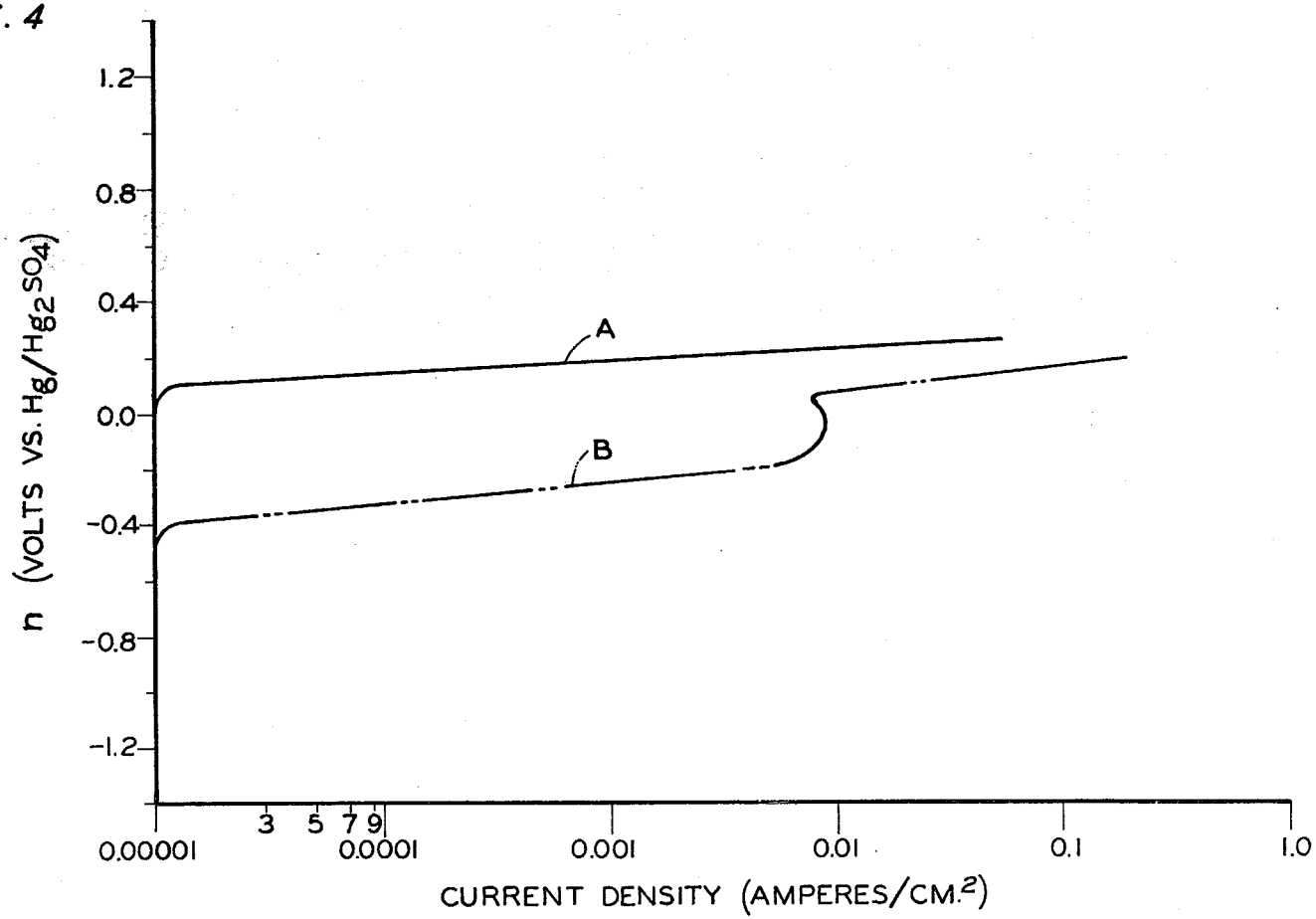
FIG. 4 shows current densities of stainless steel and nickel alloy in a particular electrolyte superimposed on a single graph.

A similar plot is tabulated for the same metals in a 0.13 N NaOH electrolyte solution as shown by FIG. 4. In this figure A indicates the plot for the nickel-based alloy and B the ferrous-based metal. It is interesting to note that between values of 0.0 volt and −0.2 volt the corrosion current density is 1000/1. Thus, while this represents a very formidable discrimination, in practice as discussed previously, the etch rate has been found to be much slower than the sulfuric acid system. Thus, while the ratio for the $H_2SO_4$ electrolyte does indicate the presence of current density and thus attack on the ferrous-based metal, in the time frame it takes to break down the alloy in the nickel alloy-ferrous metal composite, no measurable corrosion of the ferrous-based metal is detectable.

Figure 5:
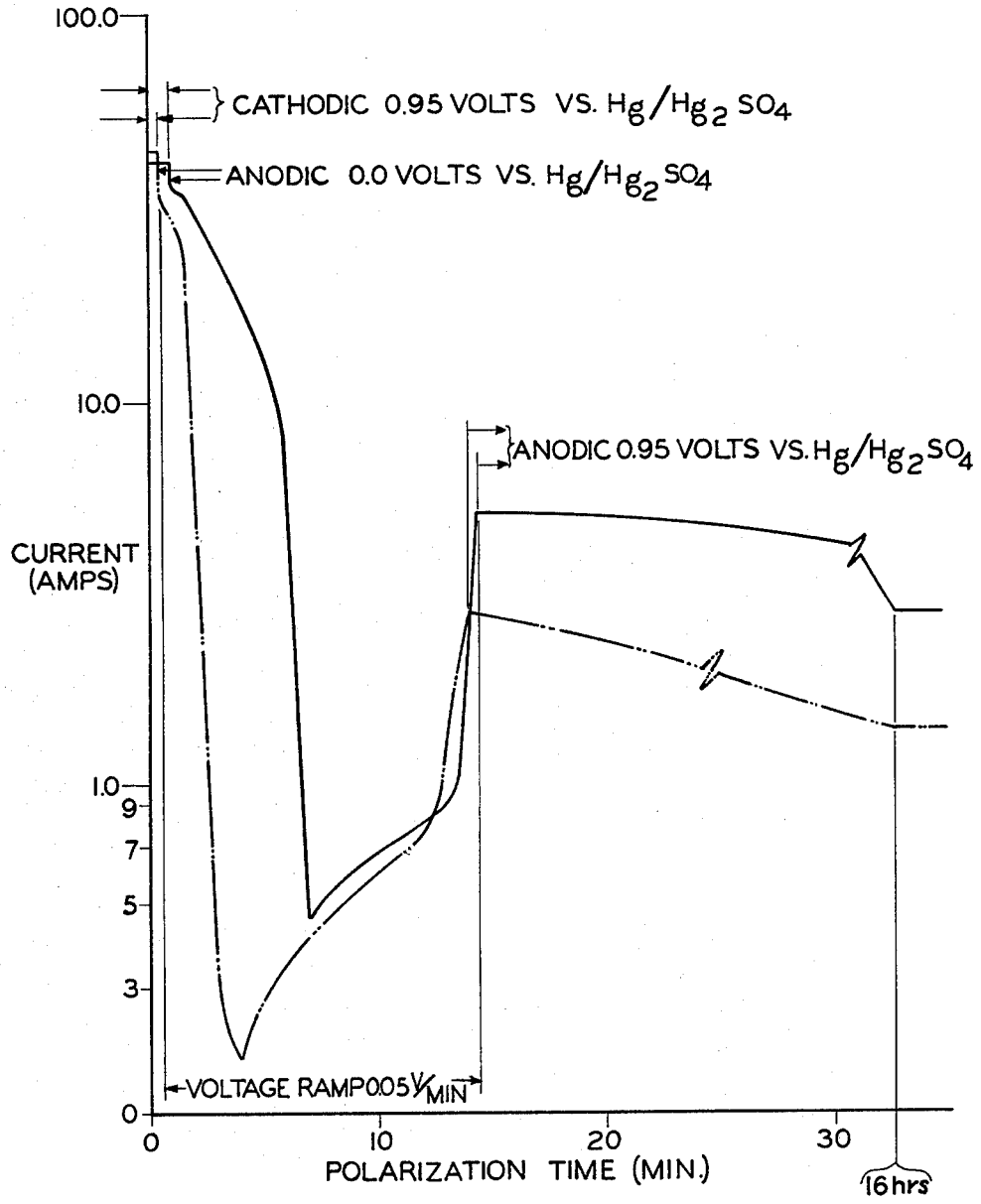
FIGS. 5 and 6 demonstrate actual voltage readouts for a particular example according to the present invention.
Figure 6:
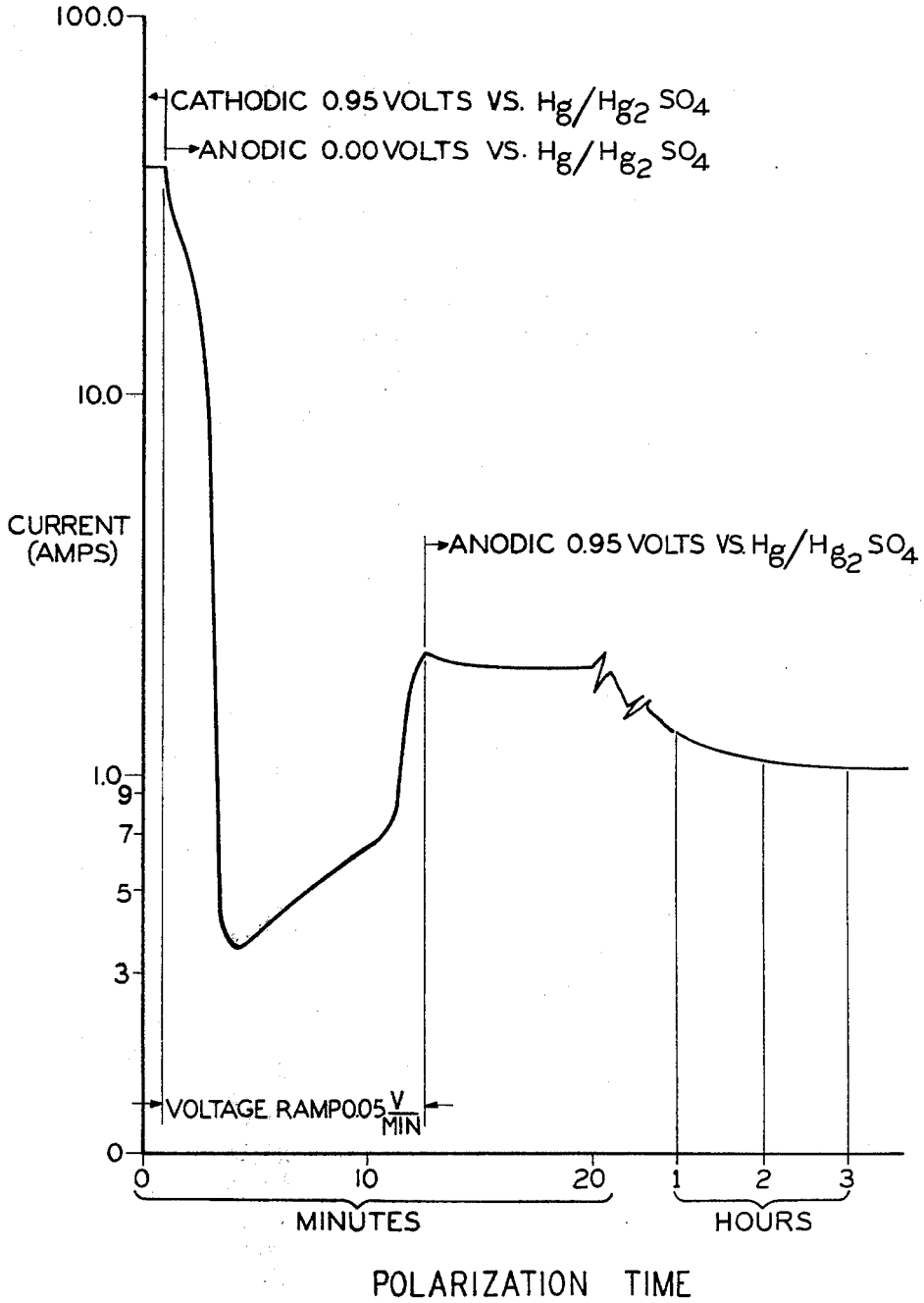

FIGS. 5 and 6 represent the actual potentiostat printouts for an alloy-brazed vane-shroud sample run. In FIG. 5 the second cycle run was substantially the same as the first except for the lower current in the workpiece (with similar voltage impressed on the sample) based on the presence of less nickel-based alloy in the second cycle. In FIG. 6, representing the third strip cycle after the vanes were removed from the shroud there is again a decrease in sample current due to, among other things, reduced braze presence.

The curves are marked to indicate the cathodic cycle of the workpiece where the hydrogen flushing takes place and anodic cycle where the alloy removal takes place. After an initial steep descent of current, a regular decline of current to passivation occurs. This is followed by a gradual current rise and a further steep rise corresponding to establishment of the potential plateau in the region of 0.8 to 0.95 volt. Holding potential at 0.95 volt for 16 hours produces only a small current decline corresponding to decrease of area of braze alloy exposed as stripping proceeds and accumulation of products of braze alloy corrosion occurs. It will be noticed that the initial current of the second cycle at 0.95 volt is virtually that at which the first cycle is ended. This indicates that the role of braze alloy decomposition products in affecting corrosion current of the braze alloy is very small. The further decline of current at 0.95 volt in the second cycle again corresponds to further removal of braze alloy. Although the third cycle (FIG. 6) is the same in form as the first two, it is not identical for two reasons: (1) removal of the vane stubs has altered the total area presented significantly and (2) a new area of residual braze alloy has been exposed by the vane stub removal.

On a second stator processed in this way, the third cycle was allowed to run 12 hours. During the late stages of this cycle, the current leveled at 0.66 ampere and at the conclusion of the cycle it was observed that all of the braze alloy had been removed. That is to say, 0.66 ampere corresponded to passivation current of the stainless steel alone. Since the estimated area of the shroud was 381 square inches (2458 $cm^2$) the corresponding current density was 0.0027 ampere per square centimeter. This is very slightly greater than the ultimate passivation current density predicted by calculation. Assuming the stator to be fundamentally iron with an electrochemical factor of 17.9 ampere-hours per square foot per 0.001 inch operating at 50% efficiency, the expected stock loss in this process is less than 0.000,080 inch. As expected, no measurable dimensional change of selected locations was detected by direct tenths-reading micrometer caliper. Also from photomicrographic observations of a vane segment removed from a shroud upon completion of the two-strip cycles, no intergranular corrosion is anywhere evident.

The current density plateau in FIG. 3 in the region of 0.8 to 0.95 volt is better described as a maximum near 0.7 volt with a minimum developing near the 0.95 volt operating potential due to the sweep rate and response lag. The polarogram of the referenced FIG. 3 was produced by voltage ramp 0.064 volt per minute. Under potentiostatic (no voltage ramp) conditions the ultimate passivity of the stainless steel proceeds well into the selected operational voltage range so that the actual working current density ratio is probably substantially higher than would be indicated from inspection of FIGS. 2 and 3.

In the potential region of 0.8 to 1.0 volt, the current density is approximately 0.0012 ampere per square centimeter. At the same potential, the nickel-based alloy current density is approximately 0.475 ampere per square centimeter. The current density ratio is therefore nearly 396. At this potential, therefore, the corrosion of nickel alloy would be approximately 400 times that of ferrous metal, clearly an effective separation of the two materials.

In another experiment a mixed surface comprising about 70% nickel alloy area and 30% ferrous-based metal area was prepared and polarized potentiostatically at 0.8 volt. After two hours under these conditions, the current density had declined from about 0.075 to about 0.04 ampere per square centimeter indicating reduction of the exposed braze alloy area by nearly 50%. This was also observed visually. It was also observed that the nickel alloy was very seriously reduced in thickness while there was no observable attack on the exposed ferrous metal-based surfaces.

It will also be understood that the current electrode must be disposed in the cell in such a way as to provide the current density demanded by the controlled potential applied. In a system such as this where one component is passivated-virtually shut off electrically - this electrode disposition is not difficult to achieve even on hardware of complex configuration. For example, in FIG. 1 the stator is shown symmetrically disposed, whereas slight offset from center would not be a problem. In this system, great preponderance of electrical current seeks the more corrodible species. It can further be arranged that the counter electrode may serve additionally as a cathodic collector of components of the braze alloy removed. This would especially apply to nickel in the present invention but could be applied to precious metal braze alloy as well.

Although the invention has been shown and described with respect to examplary embodiments thereof, it should be understood by those skilled in the art that the foregoing and various other changes, omissions and additions may be made therein and thereto, without departing from the spirit and the scope of the invention.

I claim:

1. Process for the selective removal of nickel-based alloys from ferrous-based metal/nickel-based alloy composites comprising immersing the composite in a solution of electrolyte selected from the group consisting of 4% to 6% by volume sulfuric acid and 0.1 N to 0.3 N NaOH which is substantially noncorrosive to the ferrous-based metal at voltages of 0.8 to 1.0 volt, imposing such voltage across the composite and potentiostatically controlling such voltage while the composite is immersed in the electrolyte producing a nickel alloy-ferrous metal current density ratio in the composite which selectively etches the nickel-based alloy with no damage to the ferrous-based metal.

2. A process for electrochemically removing nickel alloy brazed vanes from a ferrous-metal based shroud in a gas turbine engine stator comprising immersing the vane-shroud composite in an electrolyte solution selected from the group consisting of 4% to 6% by volume sulfuric acid and 0.1 N to 0.3 N NaOH which is noncorrosive to the shroud at voltages of 0.8 to 1.0 volt, imposing such voltage across the vane-shroud composite and potentiostatically controlling such voltage so as to produce a ratio of braze to shroud current density which selectively etches the nickel alloy braze with no damage to the shroud until the braze is sufficiently broken down to permit mechanical removal of the vanes from the shroud without damage to the shroud.

3. The process of claims 1 or 2 wherein the voltage is controlled by means of a programmable potentiostat.

4. The process of claims 1 or 2 wherein the electrolyte is 5% sulfuric acid in water.

5. The process of claims 1 or 2 wherein the nickel-based alloy comprises 4.5% silicon, 13% chromium, 4% iron, 3% boron and 75.5% nickel, and the ferrous-based metal comprises 12.5% chromium and 87.5% iron.

6. The process of claims 1 or 2 wherein the current density ratio is at least 395 to 1.

7. The process of claim 1 or 2 wherein the voltage is 0.94 to 0.96 volt.

* * * * *